US011564552B2

(12) United States Patent
Kwon et al.

(10) Patent No.: US 11,564,552 B2
(45) Date of Patent: Jan. 31, 2023

(54) DISH WASHER

(71) Applicant: LG Electronics Inc., Seoul (KR)

(72) Inventors: Soonyong Kwon, Seoul (KR); Yongjin Choi, Seoul (KR); Kyuchang Jung, Seoul (KR); Shinwoo Han, Seoul (KR); Pilsu Kim, Seoul (KR); Sangsoo Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 118 days.

(21) Appl. No.: 16/918,566

(22) Filed: Jul. 1, 2020

(65) Prior Publication Data

US 2021/0000323 A1 Jan. 7, 2021

(30) Foreign Application Priority Data

Jul. 2, 2019 (KR) ..... 10-2019-0079317

(51) Int. Cl.

| | |
|---|---|
| ***A47L 15/42*** | (2006.01) |
| ***A47L 15/23*** | (2006.01) |
| *A47L 15/10* | (2006.01) |

(52) U.S. Cl.

CPC ..... *A47L 15/4219* (2013.01); *A47L 15/23* (2013.01); *A47L 15/4223* (2013.01); *A47L 15/4225* (2013.01); *A47L 15/4234* (2013.01); *A47L 15/4278* (2013.01); *A47L 15/10* (2013.01); *A47L 15/4209* (2016.11); *A47L 15/4214* (2013.01); *A47L 2601/03* (2013.01)

(58) Field of Classification Search

CPC ..... A47L 15/4219; A47L 15/4225; A47L 15/4234; A47L 15/4209; A47L 15/23; A47L 15/4278; A47L 15/10; A47L 2601/03; A47L 15/4214; A47L 15/4223

See application file for complete search history.

(56) References Cited

FOREIGN PATENT DOCUMENTS

| | | |
|---|---|---|
| CN | 109645921 | 4/2019 |
| EP | 3494857 | 6/2019 |

(Continued)

OTHER PUBLICATIONS

NPL-1 https://www.acniti.com/technology/ultrafine-bubble-generation/ (Year: 2018).*

(Continued)

*Primary Examiner* — Benjamin L Osterhout
*Assistant Examiner* — Pallavi Chitta
(74) *Attorney, Agent, or Firm* — Fish & Richardson P.C.

(57) ABSTRACT

A dish washer includes: a tub defining a washing space, a spray module disposed inside the tub and configured to spray water to the washing space, a sump configured to store water, a washing pump configured to supply the water stored in the sump to the spray module, and an air jet generator disposed below a bottom surface of the tub and configured to receive a portion of the water discharged from the washing pump to generate air bubbles in the water and discharge the water having air bubbles to the washing space. The air jet generator includes an air pulverizing pipe including a first pipe providing a cross-sectional area reducing in a water flowing direction, a second pipe providing a cross-sectional area increasing in the water flowing direction, and an air tab disposed at an upper portion of the second pipe.

12 Claims, 9 Drawing Sheets

(56) References Cited

FOREIGN PATENT DOCUMENTS

| | | | | |
|---|---|---|---|---|
| EP | 3494858 | | 6/2019 | |
| EP | 3494859 | | 6/2019 | |
| WO | WO2018026221 | | 2/2018 | |
| WO | WO-2018026221 A | * | 2/2018 | ..... A47L 15/10 |
| WO | WO2018124717 | | 7/2018 | |

OTHER PUBLICATIONS

NPL-2 Nakatake et al., Effect of nano air-bubbles mixed into gas oil on common-rail diesel engine, Energy, vol. 59, Sep. 15, 2013, pp. 233-239 (Year: 2013).*

EP Extended European Search Report in European Appln. No. 20183486.8, dated Dec. 16, 2020, 9 pages.

* cited by examiner

DISH WASHER

CROSS-REFERENCE TO RELATED APPLICATION

The present disclosure claims priority to and the benefit of Korean Patent Application No. 10-2019-0079317, filed on Jul. 2, 2019, the disclosure of which is incorporated herein by reference in its entirety.

TECHNICAL FIELD

The present disclosure relates to a dish washer, and more particularly, to a dish washer including an air jet generator which forms an air bubble in water.

BACKGROUND

A dish washer is a household appliance which washes a food debris on a surface of the dish washer by using high-pressure water sprayed from a spray nozzle.

The dish washer includes a tub in which a washing tank is formed, and a sump which is mounted on a bottom surface of the tub to store the water. The water stored in the sump is moved to an internal space of the tub by a pumping action of a washing pump and washes a dish disposed in the internal space of the tub. In addition, foreign substances in the water are filtered by a filter, and then, the water flows into the sump. The water circulates the sump and the tub so as to wash the dish.

A conventional dish washer may disclose an air jet generator which forms air bubbles in water supplied to a tub using a portion of water fed by a washing pump.

However, when the above-described air jet generator sucks air, the air is in friction with the water, and thus, a noise may occur. The noise is generated when the dish washer is operated, and thus, the noise may cause a problem to a user who is uncomfortable with the noise.

SUMMARY

The present disclosure describes a dish washer which minimizes a noise generated when air is pulverized in an air jet generator.

The present disclosure also describes a dish washer having a plurality of structures reducing a noise generated in the air jet generator.

The structure for reducing the noise may include an air chamber on a path where the noise is propagated. However, in the case of the air jet generator which the water flows, when the water flows back into the air chamber, the water may flow into an internal space of the air chamber and remain therein.

Aspects of the present disclosure are not limited to the above-described ones. Additionally, other aspects and advantages that have not been mentioned can be clearly understood from the following description and can be more clearly understood from implementations. Further, it will be understood that the aspects and advantages of the present disclosure can be realized via means and combinations thereof that are described in the appended claims.

According to one aspect of the subject matter described in this application, a dish washer includes a tub defining a washing space, a spray module disposed inside the tub and configured to spray water to the washing space, a sump configured to store water, a washing pump configured to supply the water stored in the sump to the spray module, and an air jet generator disposed below a bottom surface of the tub and configured to (i) receive a portion of the water discharged from the washing pump to generate air bubbles in the water and (ii) discharge the water having air bubbles to the washing space. The air jet generator may include an air pulverizing pipe including a first pipe providing (i) an inlet at a lower side of the air pulverizing pipe, (ii) an opening in a water flowing direction, and (iii) a cross-sectional area reducing in the water flowing direction, and a second pipe disposed above the first pipe, the second pipe providing (i) an opening in the water flowing direction and (ii) a cross-sectional area increasing in the water flowing direction, and an air tab disposed at an upper portion of the second pipe and vertically provided with a plurality of air holes in the second pipe. An air inlet hole may be provided around a peripheral surface of the second pipe to communicate with an external component through an inlet end portion of the second pipe, and the air pulverizing pipe may include an extended surface portion which extends in a radial direction at a discharge end portion of the first pipe and extends an area of flow path of the inlet end portion of the second pipe.

Implementations according to this aspect may include one or more of the following features. For example, the air inlet hole may be separated by a predetermined interval in a radial direction from an inner circumferential surface of the discharge end portion of the first pipe.

In some examples, a diameter of the inlet end portion of the second pipe may be longer than a diameter of the air inlet hole. In some examples, the extended surface portion may be provided perpendicularly to the water flowing direction. In some examples, the air inlet hole is provided perpendicularly to a direction of a flow path where the water flows into the second pipe.

In some implementations, the first pipe may include a first pipe lower portion having a cross-sectional area reducing in the water flowing direction, the cross-sectional area reducing a pressure of the water flowing in the air pulverizing pipe and a first pipe upper portion having a corresponding cross-sectional area. A rate of change in the corresponding cross-sectional area of the first pipe upper portion may be less than that of the first pipe lower portion to increase or maintain a velocity of the water flowing through the first pipe lower portion.

In some examples, the dish washer may further include an air chamber that defines a space on a peripheral surface of the air pulverizing pipe. The air inlet hole and the external component may be in communication with each other through the air chamber. In some examples, the air chamber may include an air guide pipe extending along an inner lower surface of the air chamber within the air inlet hole. In some examples, the air inlet hole may be provided below the air chamber.

In some implementations, the dish washer may further include a chamber body defining a space therein and including an opened side on a peripheral surface of the air pulverizing pipe and a chamber housing cover covering the opened side of the chamber body.

In some examples, the dish washer may further include an impeller including a vane which provides an inclined surface in the water flowing direction to form a swirl in the water flowing into the air pulverizing pipe.

In some implementations, the dish washer may further include a nozzle mounted above the air pulverizing pipe and mounted on an upper side of the bottom surface of the tub. The nozzle may be configured to discharge the water flowing through the air pulverizing pipe to the washing space of the tube. The nozzle may be connected to an upper side of the air tab. A discharge port discharging the water to the washing space may be disposed above the bottom surface of the tub and in the nozzle. The discharge port may be provided toward the bottom surface of the tub.

In some examples, the water may flow upwards from the first pipe toward the second pipe based on the washing pump being operated.

According to another aspect of the subject matter described in this application, an air jet generator can be configured to generate air bubbles in water and discharge the water having the generated air bubbles. The air jet generator may include an air pulverizing pipe including a first pipe providing (i) an inlet at a lower side of the air pulverizing pipe, (ii) an opening in a water flowing direction, and (iii) a cross-sectional area reducing in the water flowing direction, and a second pipe disposed above the first pipe, the second pipe providing (i) an opening in the water flowing direction and (ii) a cross-sectional area increasing in the water flowing direction and an air tab disposed at an upper portion of the second pipe and vertically provided with a plurality of air holes in the second pipe. An air inlet hole may be provided around a peripheral surface of the second pipe to communicate with an outside external component through an inlet end portion of the second pipe. The air pulverizing pipe may include an extended surface portion which extends in a radial direction at a discharge end portion of the first pipe and extends an area of flow path of the inlet end portion of the second pipe.

Implementations according to this aspect may include one or more of the following features. For example, the first pipe may include a first pipe lower portion having a cross-sectional area reducing in the water flowing direction, the cross-sectional area reducing a pressure of the water flowing in the air pulverizing pipe and a first pipe upper portion having a corresponding cross-sectional area. A rate of change in the corresponding cross-sectional area of the first pipe upper portion may be less than that of the first pipe lower portion to increase or maintain a velocity of the water flowing through the first pipe lower portion.

In some examples, the air inlet hole may be separated by a predetermined interval in a radial direction from an inner circumferential surface of the discharge end portion of the first pipe. In some examples, a diameter of the inlet end portion of the second pipe may be longer than a diameter of the air inlet hole.

In some implementations, the extended surface portion may be provided perpendicularly to the water flowing direction. The air inlet hole is provided perpendicularly to a direction of a flow path where the water flows into the second pipe.

The dish washer may reduce the noise generated by the air flowing into the air pulverizing pipe through displacements of the first pipe of the air pulverizing pipe and the air inlet hole within a predetermined gap through the extended surface portion. Further, a displacement of the air chamber may further reduce the noise. Moreover, the dish washer may limit the water from remaining in the air chamber by providing the air inlet hole communicating with the air pulverizing pipe below the air chamber.

Specific contents of other implementations are included in the detail description and drawings.

DETAILED DESCRIPTION

Hereinafter, the present disclosure will be described with reference to the drawings for explaining the dish washer according to an implementation of the present disclosure.

Hereinafter, an exemplary dish washer and an exemplary flow of water inside the dish washer when a dish is washed will be described with reference to FIGS. 1 and 2.

Figure 1:
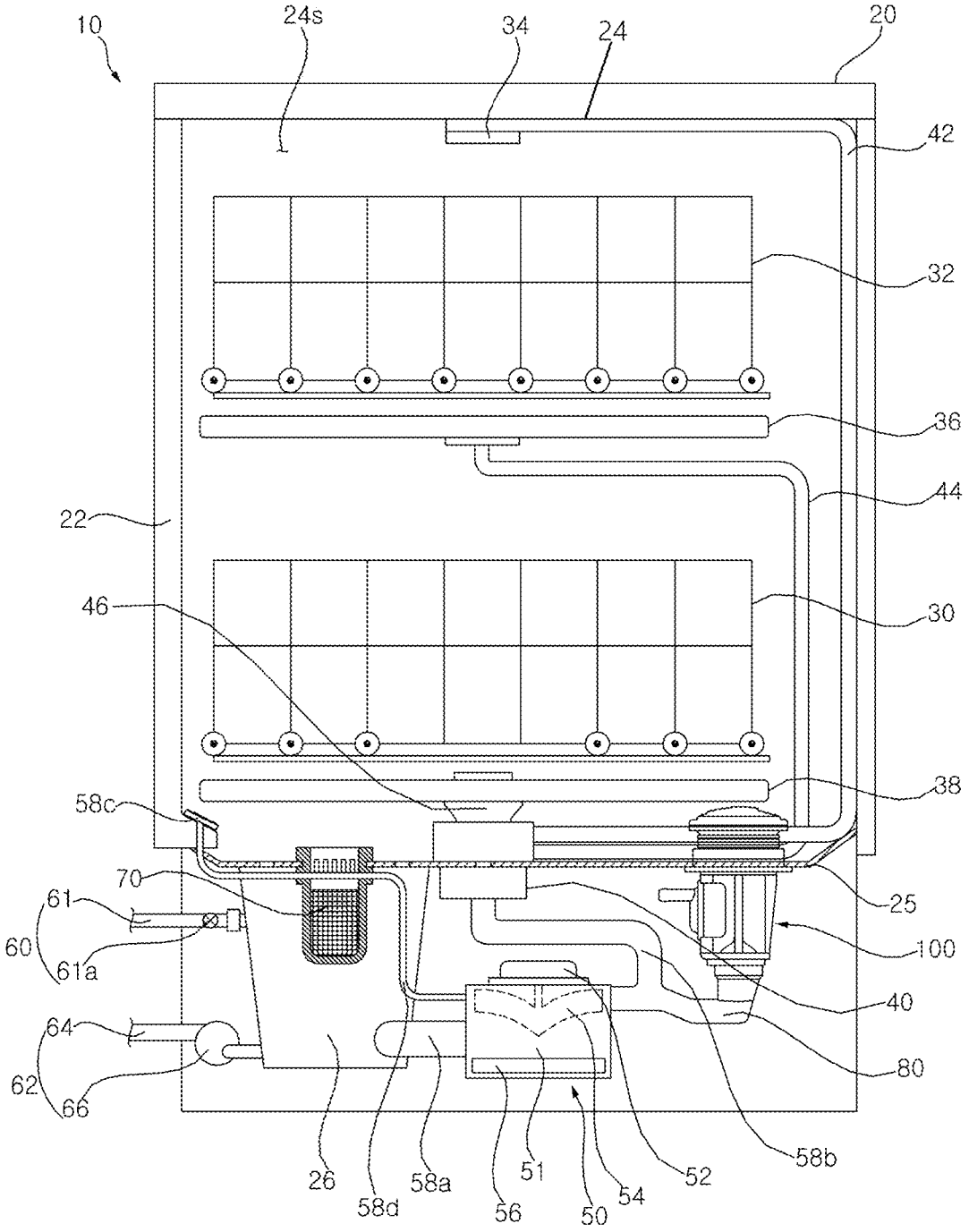
FIG. 1 is an exemplary schematic cross-sectional view of a dish washer.
Figure 2:
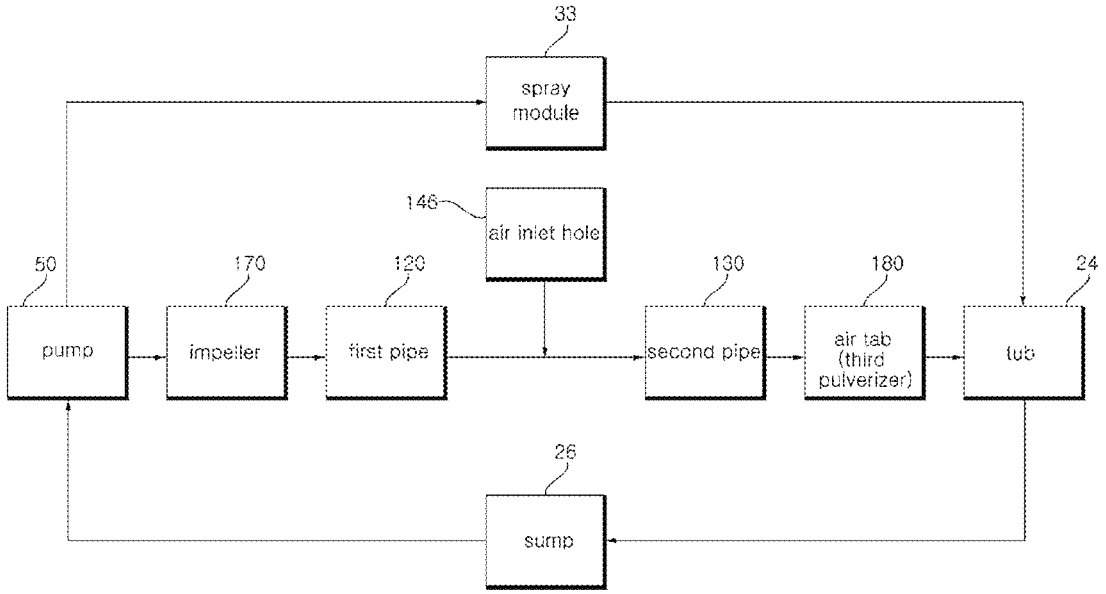
FIG. 2 is an exemplary block diagram illustrating a flow of water in the dish washer of FIG. 1.

With reference to FIG. 1, a dish washer 10 may include a cabinet 20 forming an outline, a door 22 which is coupled to the cabinet 20 and opens or closes an inside of the cabinet 20, and a tub 24 which is installed inside the cabinet 20 and forms a washing space 24*s* to which the water or steam is applied.

The dish washer 10 may further include a dispenser which stores a detergent introduced by a user and introduces the detergent into the tub 24 in a washing step. The dispenser may be disposed in the door 22. The tub 24 may form the washing space 24*s* where the dish is disposed.

The dish washer 10 may further include racks 30 and 32 storing a dish inside the tub 24, a spray module 33 spraying the water toward the dish accommodated in the racks 30 and 32, a sump 26 supplying the water to the spray module 33, and a washing pump 50 pressure-feeding the water stored in the sump 26 to the spray module 33.

The spray module 33 can be configured to spray the water toward the dish, and may include spray nozzles 34, 36, and 38 and supply pipes 42, 44, and 46 connecting the washing pump 50 and the spray nozzles 34, 36, and 38 to each other.

The dish washer 10 may further include a washing motor 52 driving the washing pump 50, and a brushless direct current motor (BLDC) which can control a rotating speed of the washing motor 52.

The dish washer 10 may further include a water supply module 60 which supplies water to the sump 26 or the spray module, a water discharge module 62 which is connected to the sump 26 and discharges the water from the sump 26, a filter module 70 installed in the sump 26 and filters the water, and a heating module which is installed in the sump 26 and heats the water.

In some implementations, the dish washer 10 may include the plurality of spray nozzles 34, 36, and 38, the plurality of supply pipes 42, 44, and 46 through which the water pressure-fed from the washing pump 50 are respectively supplied to the plurality of spray nozzles 34, 36, and 38, and a channel switcher 40 which supplies the water pressure-fed from the washing pump 50 to at least one of the spray nozzles 34, 36, and 38.

The water supply module 60 can be configured to receive the water supplied from the outside and supply the water to the sump 26, and open or close a water supply valve 61*a* disposed in a water supply flow path 61 to supply the water from the outside into the sump 26. The water discharge module 62 can be configured to discharge the water stored in the sump 26 to the outside and includes a water discharge flow path 64 and a water discharge pump 66.

The filter module 70 can be configured to filter foreign matters such as a food debris contained in the water and can be disposed in a path of the water flowing from the tub 24 into the sump 26.

The dish washer 10 may further include the washing pump 50 which pressure-feeds the water stored in the sump 26 to the spray nozzles 34, 36, and 38. The washing pump 50 includes a washing pump housing 51, a washing pump impeller 54 which is disposed inside the washing pump housing 51 and rotated to supply the water to the spray nozzles 34, 36, and 38, a washing motor 52 which rotates the washing pump impeller 54, and a heater 56 which heats the water inside the washing pump housing 51.

The washing pump 50 is connected to the sump 26 through the water supply pipe 58*a* and connected to the channel switcher 40 through a water outlet pipe 58*b*. A branching pipe 80 is formed in the water outlet pipe 58*b*, and a portion of the water flowing from the washing pump 50 can flow to an air jet generator 100 through the branching pipe 80.

Steam generated by the heater 56 disposed in the washing pump 50 may flow into a steam nozzle 58*c* through a steam discharge pipe 58*d* and may be supplied into the tub 24 through the steam nozzle 58*c*.

The dish washer 10 may include the air jet generator 100 which forms air bubbles having a minute size in the water.

In the dish washer 10, a portion of the water supplied by the washing pump 50 is supplied to the air jet generator 100 in addition to the spray module 33 through the branching pipe 80. The portion of the water may include air and the air jet generator 100 may pulverize the air to generate minute air bubbles. The air jet generator 100 is connected to the tub 24 or the sump 26. Accordingly, when the pump is operated, the air jet generator 100 supplies the water having the generated air bubbles to the sump 26, and thus, the water pressure-fed to the spray module 33 includes the air bubbles.

A lower hole through which a portion of an upper side of the air jet generator 100 passes is formed at a bottom of the tub 24. An upper portion of an air pulverizing pipe of the air jet generator 100 passes through the lower hole and will be described below. For example, a portion of the upper portion of the air pulverizing pipe of the air jet generator 100 is disposed at the bottom of the tub 24.

The exemplary flow of the water will be described with reference to FIG. 2. The water stored in the sump 26 of the dish washer 10 is supplied to the spray module 33 through the washing pump 50. The water supplied to the spray module 33 is sprayed to the tub 24, and the water sprayed to the tub 24 flows into the sump 26 again. In the dish washer 10, a portion of the water fed from the washing pump 50 flows into the air jet generator 100 which generates the air bubbles in the water. The portion of the water may flow into the air jet generator 100 through the branching pipe 80.

The portion of the water flowing into the air jet generator 100 may pass through an impeller 170, an air inlet hole 146, the air pulverizing pipe including a first pipe 120 and a second pipe 130, and an air tab 180 to generate the air bubbles in the water. That is, the water flowing into the air jet generator 100 flows swirly by the impeller 170. Thereafter, a speed of the water increases while passing through the first pipe 120, and air flowing into the air inlet hole is primarily pulverized by the washing waster which is rotated at a high speed by the impeller 170 and the first pipe 120. Moreover, the water is secondarily pulverized while passing through the second pipe 130 and thirdly pulverized while passing through the air tab 180, and thus, includes air bubbles having a minute size.

The water including the air bubbles flows into the sump 26 again. For example, the water including the air bubbles may be discharged to the tub 24 and may flow into the sump 26. Accordingly, when the washing pump 50 is operated by operating the dish washer 10, the air bubbles are generated in the water.

Hereinafter, an exemplary implementation and disposition of the air jet generator will be described with reference to FIGS. 3 to 9B.

The air jet generator 100 may be disposed on a rear side of a bottom surface 25 of the tub 24. In some implementations, the air jet generator 100 may be disposed at an edge side of the bottom surface 25 of the tub 24.

Figure 3:
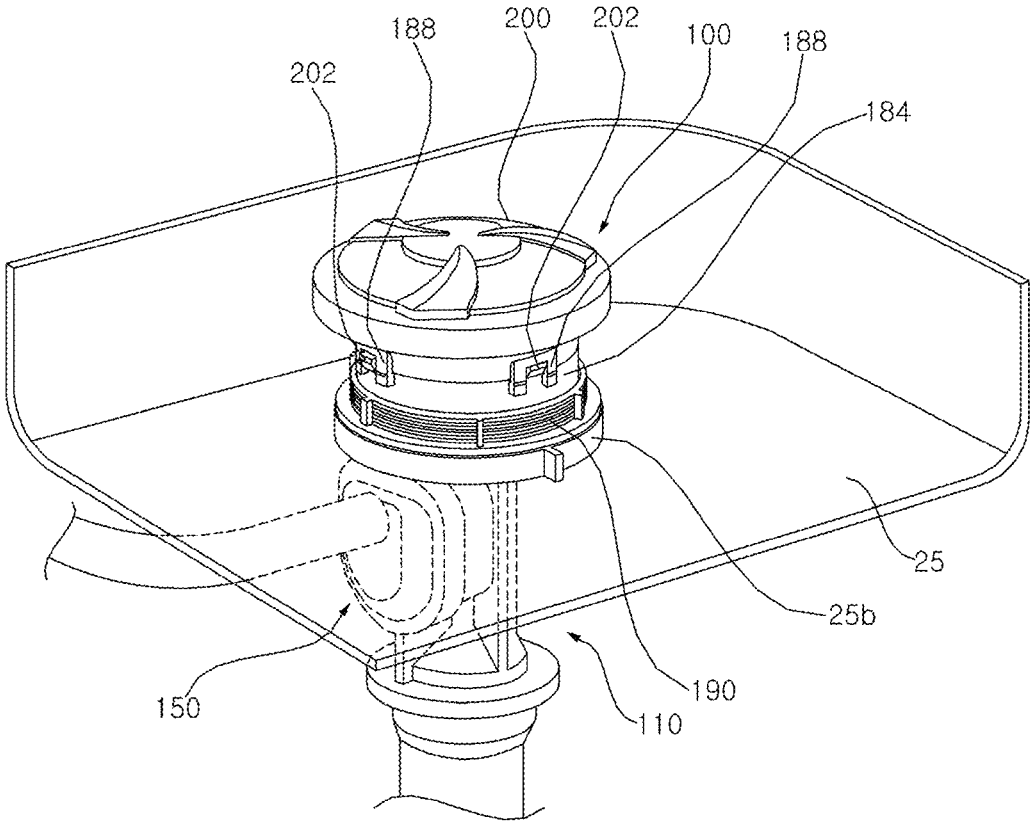
FIG. 3 is an example of an air jet generator structure mounted on a tub.
Figure 4:
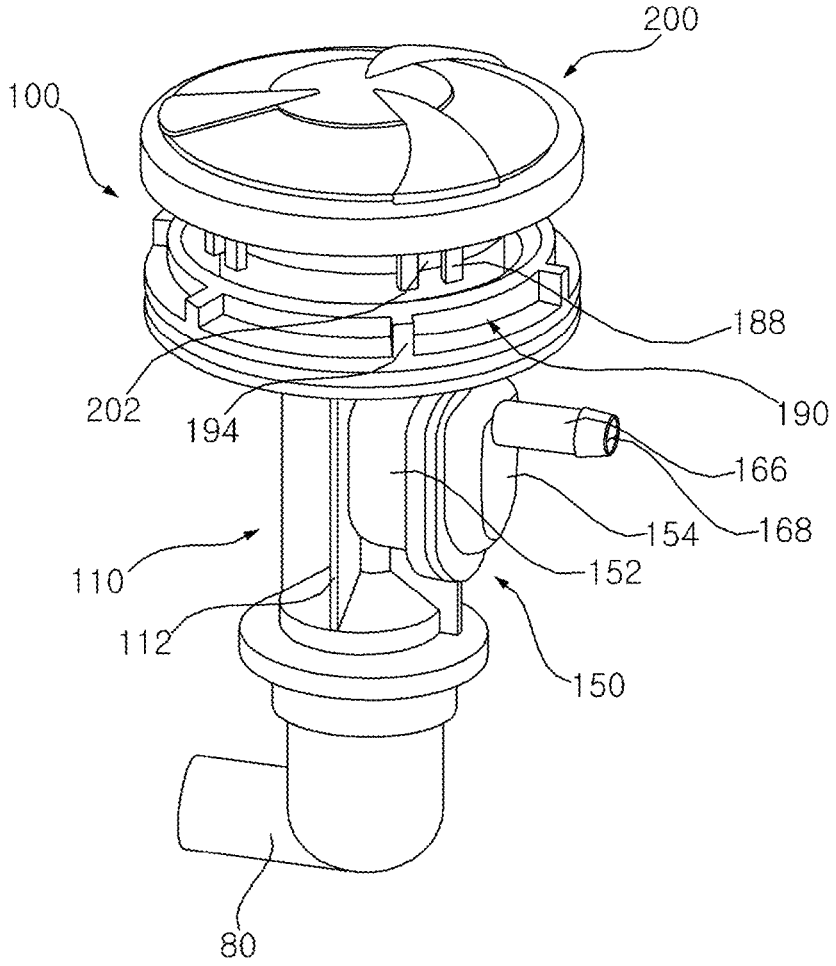
FIG. 4 is an exemplary diagram illustrating a perspective view of the air jet generator.
Figure 5:
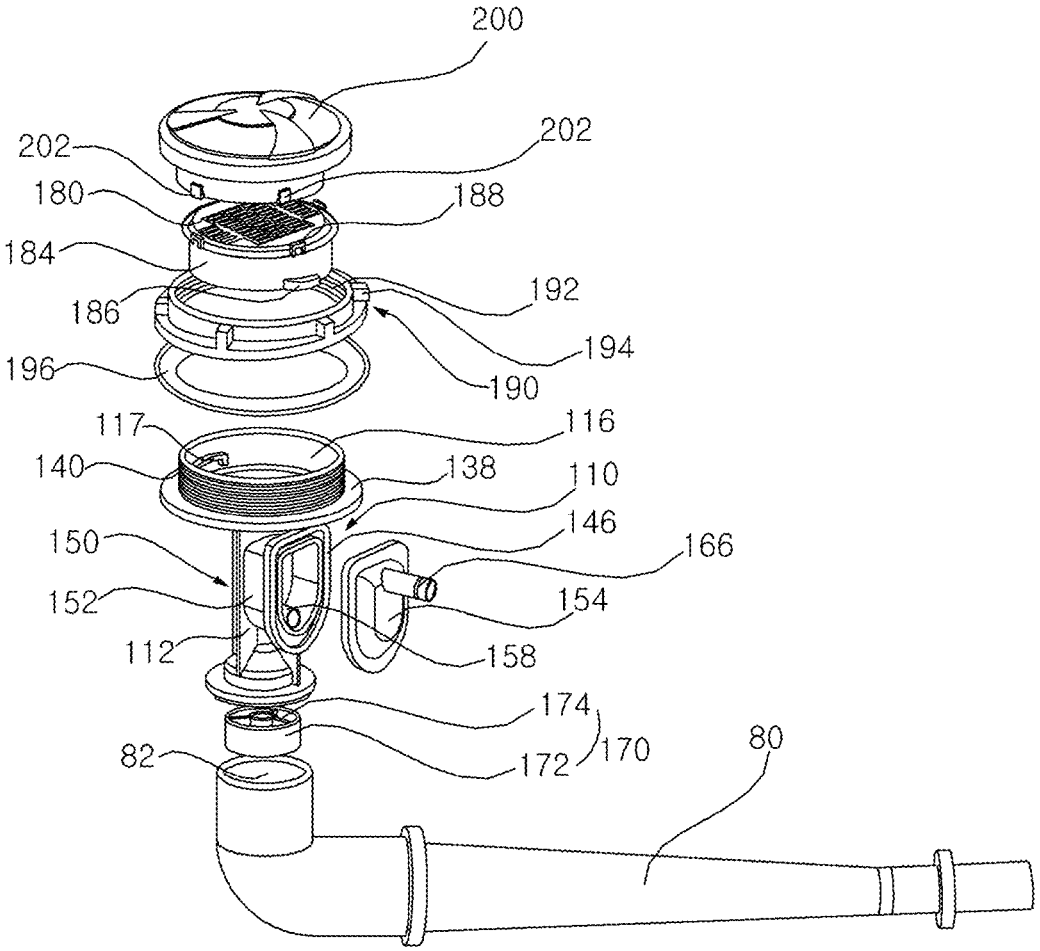
FIG. 5 is an exemplary diagram illustrating an exploded perspective view of the air jet generator.
Figure 6:
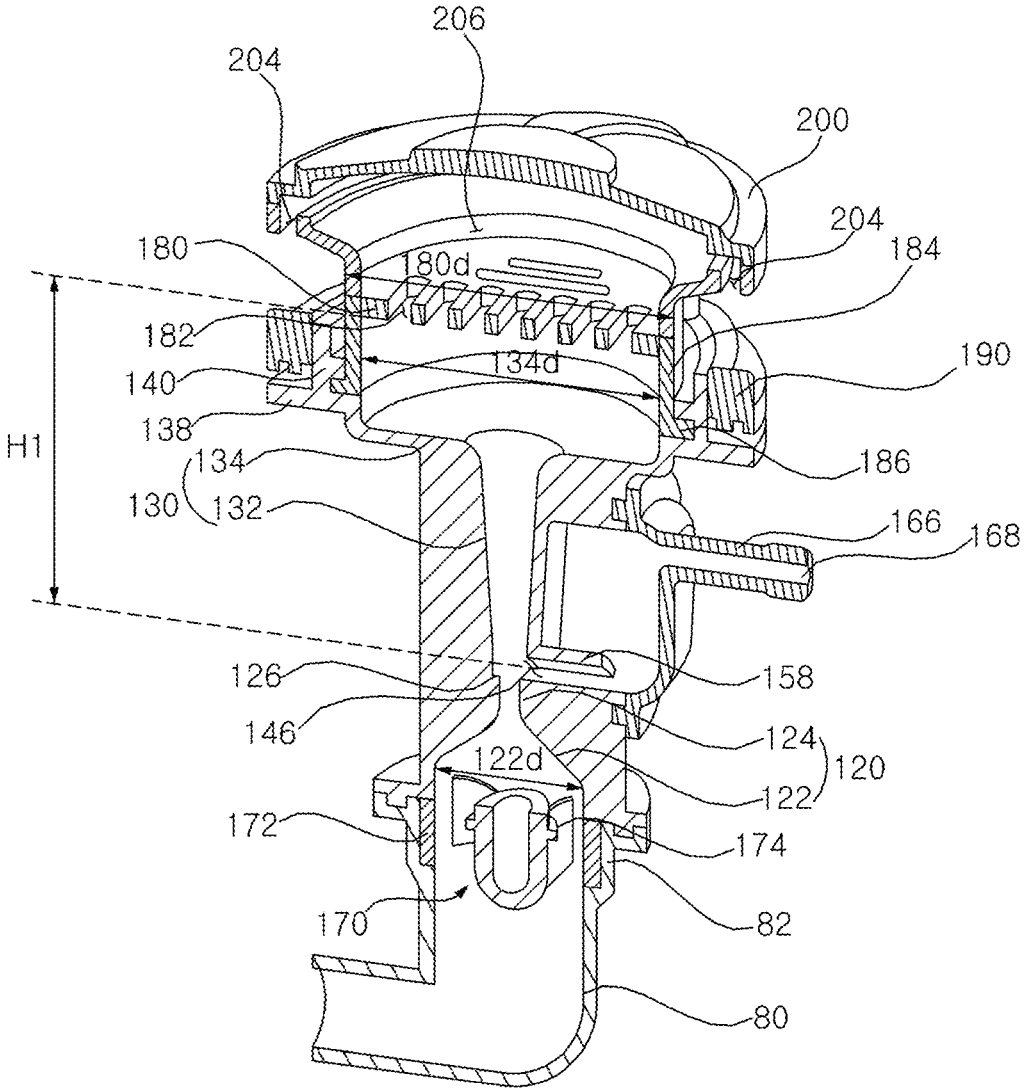
FIG. 6 is an exemplary diagram illustrating a side cross-sectional perspective view of the air jet generator.
Figure 7:
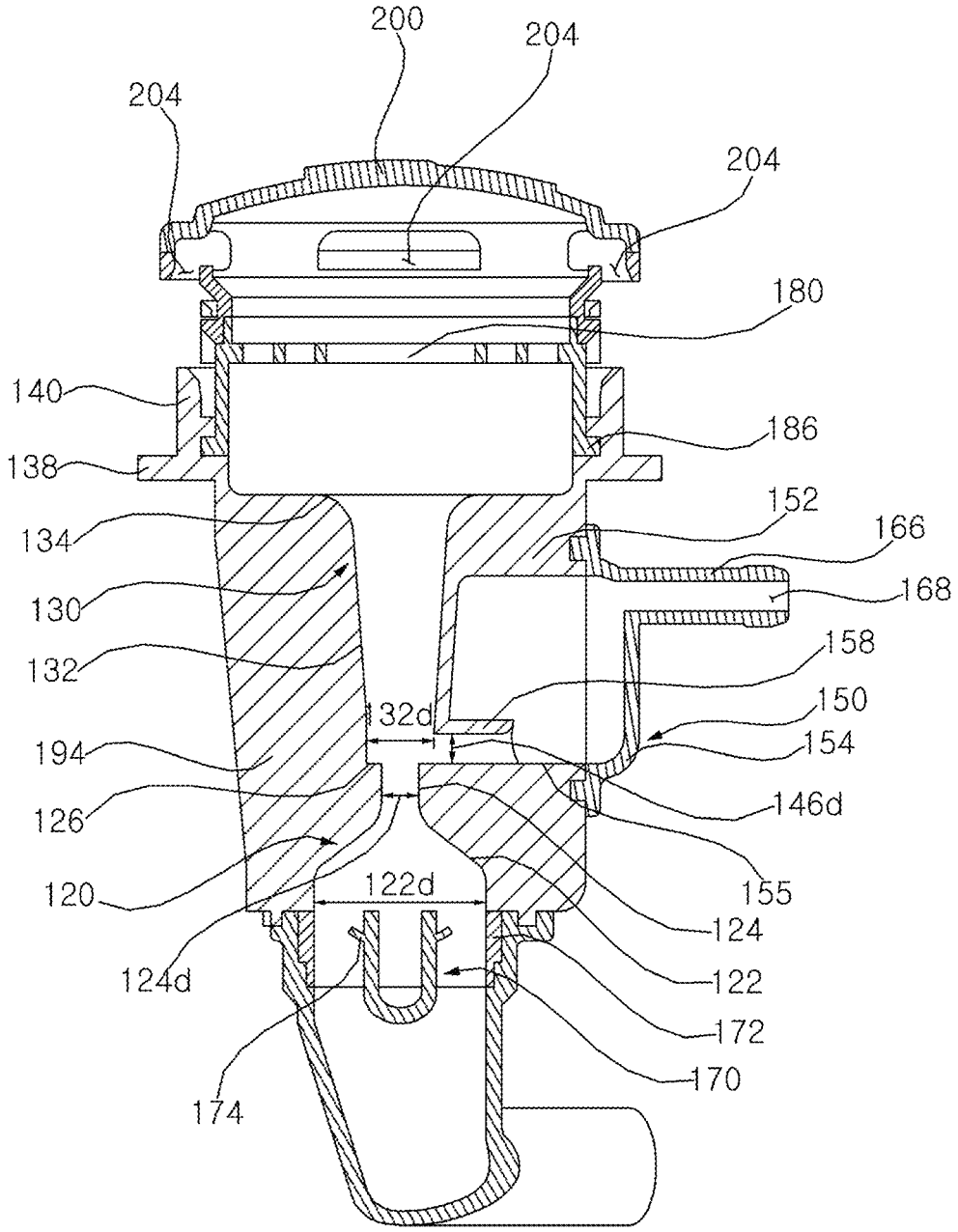
FIG. 7 is an exemplary diagram illustrating a side cross-sectional view of the air jet generator.

Referring to FIG. 3, a mounting hole where a part of the air jet generator 100 passes is formed in a portion where the air jet generator 100 is mounted, and a mounting surface 25*b* on which the air jet generator 100 is mounted is formed around the mounting hole.

A fixing ring 190 is disposed above the mounting surface 25*b* and will be described later. The mounting surface 25*b* forms a flat surface to be in close contact with a lower side of the fixing ring 190.

The air jet generator 100 may form a flow path perpendicular to the bottom surface 25 of the tub 24 or a ground and has a shape of a venturi tube. The air jet generator 100 may include the air pulverizing pipe 110 in which the air inlet hole 146 is formed. In some implementations, an external air may flow from one side of the air inlet hole 146 and through the air inlet hole 146. The air jet generator 100 may further include the air tab 180 which pulverizes the air existing in the water discharged from the air pulverizing pipe 110, and an air chamber 150 which forms a space for the air flow and the air inlet hole (e.g., air inlet hole 146 in FIG. 5) to communicate with an inside of the air pulverizing pipe 110 on one side of a lower portion. Moreover, the air jet generator may further include the impeller 170 which applies a centrifugal force to the water flowing to the air pulverizing pipe 110.

The dish washer 10 may further include the branching pipe 80 which causes a portion of the water flowing from the washing pump 50 to the spray module 33 to flow to the air jet generator 100. For example, an end portion of the branching pipe 80 may be coupled to the lower portion of the air pulverizing pipe 110. In some implementations, the branching pipe 80 and the air pulverizing pipe 110 may be coupled to each other using a fusion method.

A portion of the water flowing through the water outlet pipe 58*b* is supplied to the air jet generator 100 through the branching pipe 80. That is, the branching pipe 80 branches off at the water outlet pipe 58*b* and is connected to the air jet generator 100.

The impeller 170 which applies a centrifugal force to the water flowing into the air pulverizing pipe 110 may be disposed at the end portion of the branching pipe 80. An impeller mounting portion 82, mounting the impeller 170, may be formed inside one side of the branching pipe 80. In some implementations, the impeller 170 may be coupled to the impeller mounting portion 82 of the branching pipe 80 by a fusion method.

The impeller 170 includes a cylindrical impeller peripheral portion 172 and a vane 174. The vane 174 may be disposed inside the impeller peripheral portion 172 and may form a swirl in the water. In the impeller 170, an outer surface of the impeller peripheral portion 172 is disposed close to an inside of a discharge end portion of the branching pipe 80. As the water passes through the vane 174, the water is rotated to generate the swirl.

The vane 174 of the impeller 170 applies the centrifugal force to the water flowing through the first pipe 120. In some implementations, the vane 174 of the impeller 170 may be fixed or rotated, and the water passing through the vane 174 is rotated and flows into the air pulverizing pipe 110.

In some implementations, the air pulverizing pipe 110 has the shape of a venturi tube and pulverizes the air from the water, the air flowing through the air inlet hole 146.

In some implementations, the air pulverizing pipe 110 includes the first pipe 120 having a cross-section area which is reduced in a direction, the direction which the water flows to reduce a pressure of the water flowing through the air pulverizing pipe 110. The air pulverizing pipe 110 may further include the second pipe 130 having a cross-sectional area which increases in a direction, the direction which the water flows to pressurize the water including the air. Each of the first pipe 120 and the second pipe 130 has an open channel. In some implementations, the open channel may be implemented in up-down direction. The first pipe 120 is located on an upstream side of the second pipe 130 and is located below the second pipe 130.

The air inlet hole 146 where the external air flows into the air pulverizing pipe 110 by a generated negative pressure from the air pulverizing pipe 110 is formed on a peripheral surface of a lower end portion of the second pipe 130. In some implementations, the air inlet hole 146 is formed on an upstream end portion of the second pipe 130.

The air pulverizing pipe 110 is disposed below the bottom surface 25 of the tub 24. In some implementations, the air pulverizing pipe 110 is disposed to be perpendicular to the ground or the bottom surface 25 of the tub 24.

In some implementations, the first pipe 120, the second pipe 130, and an air tab mounting portion 116 may be disposed in the air pulverizing pipe 110 in order with respect to the water flowing direction.

The air pulverizing pipe 110 may further include an air tab mounting portion 116, mounting the air tab 180, at the discharge end portion where the water is discharged. In some implementations, the air tab mounting portion 116 may have a shape surrounding the air tab 180 to insert the air tab 180 into the air tab mounting portion 116. The air tab mounting portion 116 is disposed on an upper side of the air pulverizing pipe 110.

In some implementations, a size of an inlet cross section of the first pipe 120 is smaller than a size of a discharge cross section of the second pipe 130. The air pulverizing pipe 110 is disposed to be perpendicular to the ground or the bottom surface 25 of the tub 24. The channel formed inside the air pulverizing pipe 110 is formed to be perpendicular to the ground or the bottom surface 25 of the tub 24.

The first pipe 120 is disposed below the second pipe 130. For example, the water flows from the lower side to the upper side, and thus, the first pipe 120 is disposed on an upstream side of the second pipe 130. In the first pipe 120, the cross-sectional area is reduced in the flow direction of the water. A length of the channel formed by the first pipe 120 is shorter than a length of the channel formed by the second pipe 130. A diameter of the channel on a lower end portion 122*d* of the first pipe 120 is shorter than a diameter of the channel on an upper end portion 134*d* of the second pipe 130.

The first pipe 120 may include a first pipe lower portion 122 of which a cross-sectional area is rapidly reduced to reduce the pressure of the water flowing into the air pulverizing pipe 110, and a first pipe upper portion 124 which is disposed on a downstream side of the first pipe lower portion 122 and increases or maintains a velocity of the water flowing through the first pipe lower portion 122.

The first pipe lower portion 122 is disposed below the first pipe upper portion 124. A rate of change in the cross-sectional area of the first pipe upper portion 124 is less than a rate of change in the cross-sectional area of the first pipe lower portion 122.

The cross-sectional area of the first pipe lower portion 122 is rapidly reduced from the upstream side to the downstream side. For example, a reduction ratio of the cross-sectional area of the first pipe lower portion 122 is greater than that of the first pipe upper portion 124. The pressure of the water flowing through the first pipe 120 of the air pulverizing pipe 110 is reduced while passing through the first pipe lower portion 122 and the first pipe upper portion 124 forming a negative pressure.

The second pipe 130 is disposed above the first pipe 120. The second pipe 130 is disposed on a downstream side of the first pipe 120. The cross-sectional area of the second pipe 130 increases in the flow direction of the water, and pressurizes the water. The water moving along the second pipe 130 is pressurized, and thus, the air flowing into the air pulverizing pipe 110 through the air inlet hole 146 is secondarily pulverized.

In some implementations, the second pipe 130 may be formed to be longer than the first pipe 120. The second pipe 130 may include a second pipe lower portion 132 which primarily pressurizes the water flowing from the first pipe 120 and a second pipe upper portion 134 which secondarily pressurizes the water passing through the second pipe lower portion 132. The second pipe lower portion 132 slowly pressurizes the water compared to the second pipe upper portion 134. A change ratio of a cross-sectional area of the second pipe lower portion 132 is less than that of the second pipe upper portion 134. For example, referring to FIGS. 6 and 7, a length of a channel of the second pipe lower portion 132 formed in an up-down direction is longer than a length of a channel of the second pipe upper portion 134. A difference between inner diameters of both end portions of the second pipe lower portion 132 in the up-down direction is less than a difference between inner diameters of both end portions of the second pipe upper portion 134 in the up-down direction.

In the second pipe lower portion 132, the air flowing into the air inlet hole 146 is pulverized by the flow velocity and the centrifugal force of the water. In the second pipe upper portion 134, the cross section is rapidly extended. Accordingly, the water is pressurized, and the air existing inside the water can be effectively pulverized.

The second pipe 130 may further include an extended pipe portion which maintains the cross section extended by the second pipe upper portion 134. The extended pipe portion is connected to an inner peripheral surface of an air tab peripheral surface 184. The extended pipe portion and the inner peripheral surface of the air tab peripheral surface 184 can adjust a distance of the air tab 180 separated from the air inlet hole 146. In order to effectively pulverize the air by the air tab 180, preferably, a distance H1 of the air tab 180 separated from the air inlet hole 146 is equal to or longer than a diameter 180*d* of the air tab 180. Accordingly, a sum (which is equal to distance H1) of the lengths of the channel formed by the second pipe lower portion 132, the second pipe upper portion 134, the extended pipe portion, and the inner peripheral surface of the air tab peripheral surface 184 is equal to or greater than the diameter 180*d* of the air tab 180.

The air inlet hole 146 is formed on an upstream end portion of the second pipe 130. The air inlet hole 146 is formed on a lower end portion of the second pipe 130.

The air inlet hole 146 may be formed between the first pipe 120 and the second pipe 130. The air inlet hole 146 is formed in a portion where the cross section of the first pipe 120 is reduced. The air inlet hole 146 is formed at the upstream end portion of the second pipe 130. The air inlet hole 146 may be formed at a point where the reduction in the pressure of the first pipe 120 ends. The air inlet hole 146 may be formed at a point where the pressurization by the second pipe 130 starts.

The inside of the air pulverizing pipe 110 and the outside of the air pulverizing pipe 110 communicate with each other through the air chamber 150. The air chamber 150 will be described later with respect to the air inlet hole 146. In the air pulverizing pipe 110, the external air can flow to the inside of the air pulverizing pipe 110 through the air inlet hole 146. The outside may refer to the outside of the air pulverizing pipe 110, and may include not only an outside of the cabinet 20 but also the space inside the cabinet 20 and an internal space of the tub 24.

The pressure of the water flowing through the air pulverizing pipe 110 is reduced while passing through the first pipe 120. A negative pressure is generated by the reduction in the pressure of the water passing through the first pipe, and thus, the external air is sucked into the air pulverizing pipe 110 through the air inlet hole 146. The air flowing into the air pulverizing pipe 110 through the air inlet hole 146 is primarily pulverized by the rotating current flowing at a high speed along the first pipe 120.

The air pulverizing pipe 110 is disposed between the first pipe 120 and the second pipe 130, extends radially from the discharge end portion of the first pipe 120, and includes the extended surface portion 126 which expands the area of flow path of the inlet end portion of the second pipe 130. Accordingly, the air inlet hole 146 formed on the peripheral surface of the second pipe 130 is disposed to be radially separated from the discharge end portion of the first pipe 120 by a gap forming the extended surface portion 126.

The extended surface portion 126 forms a stepped portion between the first pipe 120 and the second pipe 130. The extended surface portion 126 can reduce a noise generated by a friction between the air flowing through the air inlet hole 146 and the water flowing to the second pipe 130 through the first pipe 120.

A diameter of the lower end portion of the second pipe 130 is longer than a diameter 122*d* of the flow path cross section of the upper end portion of the first pipe 120. The flow path cross section of the upstream end portion of the second pipe 130 extends by a predetermined gap or more than that of the downstream end portion of the first pipe 120. The diameter 132*d* of the flow path cross section of the lower end portion of the second pipe 130 is longer than a diameter 146*d* of the air inlet hole 146.

The upper end portion of the first pipe 120 is connected to the lower end portion of the second pipe 130 through the extended surface portion 126 expanding the flow path cross section. The extended surface portion 126 formed in the lower end portion of the second pipe 130 expands the gap 132*d* between the air inlet hole 146 and the inner surface of the second pipe 130 facing the air inlet hole 146. Accordingly, the air inlet hole 146 colliding with the inner surface of the second pipe 130 facing the air inlet hole 146 may reduce the noise generated by the air flowing into the air pulverizing pipe 110.

The air chamber 150 which reduces the noise generated in the air pulverizing pipe 110 may be disposed on one side of the air pulverizing pipe 110. For example, the air chamber 150 may reduce the noise transmitted to the outside through the air inlet hole 146.

In some implementations, the air chamber 150 may form a space where the noise is transmitted. In some implementations, the air chamber 150 may be disposed outside the air pulverizing pipe 110 in which the air inlet hole 146 is formed. In some implementations, the air chamber 150 may include the air inlet hole 146 which can communicate with the inside of the air pulverizing pipe 110 on one side of the lower end portion.

The air inlet hole 146 is formed on the lower end portion of the air chamber 150. Accordingly, even when the water flows into the air chamber 150, the water is extracted to the air inlet hole 146 formed on the lower end portion of the air chamber 150, and thus, the water is not accumulated inside the air chamber 150. In some implementations, an outside air inflow hole 168 where the outside air flows into the air chamber 150 may be formed in the air chamber 150. In some implementations, the outside air inflow hole 168 may be formed in an upper end portion of the air chamber 150. Accordingly, the water flowing into the air chamber 150 is prevented from being extracted to the outside of the air chamber 150.

In some implementations, the air chamber 150 is disposed outside the air pulverizing pipe 110 where the air inlet hole 146 is formed. A space is formed inside the air chamber 150, and the air chamber 150 includes a chamber body 152 of which one side is open and a chamber cover 154 which covers the open one side of the chamber body 152.

In some implementations, the chamber body 152 protrudes from one side of the air pulverizing pipe 110 to form a space therein and may be integrally formed with the air pulverizing pipe 110. Moreover, the chamber cover 154 may be configured to be separated from the chamber body 152 so as to be coupled to the chamber body 152.

In some implementations, the chamber body 152 and the chamber cover 154 may communicate with the inner flow path of the air pulverizing pipe 110 and may be constituted by implementations separated from each other to form a space where the noise is propagated. The chamber body 152 and the chamber cover 154 can be manufactured into the implementations separated from each other or coupled to each other, and thus, it may be possible to secure the space inside the air chamber 150. For example, the chamber cover 154 may be coupled to the chamber body 152 by a fusion method.

In some implementations, the chamber body 152 may be disposed on the one side forming a periphery of the air pulverizing pipe 110 so that a coupling process including a separate manufacturing process can be omitted. The chamber body 152 is disposed on the one side forming the periphery of the air pulverizing pipe 110 and may play a role of reinforcing rigidities of the air pulverizing pipe 110 together with reinforcement protrusions 112.

In some implementations, the chamber body 152 may be formed on an outer periphery of the air pulverizing pipe 110 where the air inlet hole 146 is formed. For example, the air inlet hole 146 is formed on one side of the air pulverizing pipe peripheral surface being in contact with an inner lower surface 155 of the chamber body 152. Accordingly, the water accumulated in the chamber body 152 can flow to the air inlet hole 146. In some implementations, one side surface of the chamber body 152 facing the air inlet hole 146 may be open. For example, the chamber cover 154 is disposed on the opened side surface of the chamber body 152 facing the air inlet hole 146. In some implementations, the chamber cover 154 may cover the opened side surface of the chamber body 152. The chamber cover 154 includes the outside air inflow hole 168 where the outside air flows. In addition, the chamber cover 154 includes an external connection pipe 166 which protrudes outward in a portion where the outside air inflow hole 168 is formed. A separate connection hose which is connected to the outside of the cabinet 20 may be mounted on the external connection pipe 166.

In some implementations, the air chamber 150 may include an air guide pipe 158 which extends along the inner lower surface 155 of the air chamber 150 in the air inlet hole 146. The air guide pipe 158 expands a path where the noise is propagated inside the air chamber 150 to reduce the noise. The air guide pipe 158 forms the inner lower surface 155 of the chamber body 152.

In some implementations, the air pulverizing pipe 110 may include an air tab mounting portion 116 which is formed to mount the air tab 180 above the extended pipe portion 136. The air tab mounting portion 116 is formed to have a size to mount the air tab 180 inside the air tab mounting portion 116. The air tab 180 is detachably mounted on the air tab mounting portion 116. For example, when the air pulverizing pipe 110 is mounted on the tub 24, the air tab mounting portion 116 is disposed above the air pulverizing pipe 110. The air tab mounting portion 116 is disposed above the second pipe 130 of the air pulverizing pipe 110 in the water flowing direction.

The air tab mounting portion 116 is attached to the air tab 180. The air tab mounting portion 116 includes a fastening groove 117 which is formed to correspond to a fastening protrusion 186 of the air tab 180. The air tab mounting portion 116 is disposed above the bottom surface 25 of the tub 24.

In some implementations, the air pulverizing pipe 110 may include a tub mounting portion which is attached to the bottom surface 25 of the tub 24. The tub mounting portion is formed on an outer periphery of the air pulverizing pipe 110 which is the upper side of the second pipe 130. In some implementations, the tub mounting portion is formed on the outer peripheral surface of the air tab mounting portion 116. The tub mounting portion includes a lower fixing plate 138 which circumferentially protrudes from an outer peripheral surface of the air pulverizing pipe 110 and an upper fixing portion 140 which protrusions up toward the bottom surface of the tub 24 and is fastened to the fixing ring 190.

The lower fixing plate 138 is formed in a ring shape protruding outward along the outer periphery of the air pulverizing pipe 110. The lower fixing plate 138 is disposed below the bottom surface 25 of the tub 24. The lower fixing plate 138 is disposed to face the bottom surface 25 of the tub 24. The lower fixing plate 138 prevents the air pulverizing pipe 110 from moving upward from the bottom surface 25 of the tub 24.

A portion of the upper fixing portion 140 is disposed above the bottom surface of the tub 24. The upper fixing portion 140 forms a thread to fasten the fixing ring 190 to the outer peripheral surface of the air pulverizing pipe 110. The bottom surface 25 of the tub 24 is disposed between the lower fixing plate 138 and the fixing ring 190 fastened to the upper fixing portion 140. The upper fixing portion 140 is coupled to the fixing ring 190 and prevents the air pulverizing pipe 110 from moving downward.

The fixing ring 190 has a ring shape and is fastened to the upper fixing portion 140 of the air pulverizing pipe 110. An inner peripheral surface 192 of the fixing ring 190 has a thread corresponding to the upper fixing portion 140. In the fixing ring 190, a plurality of reinforcing ribs 194 which maintain rigidities of the fixing ring 190 and function as a handle is formed along an outer periphery. The reinforcing ribs 194 are formed to be perpendicular to an outer peripheral surface of the fixing ring 190 at regular intervals.

The air pulverizing pipe 110 includes an upper portion which is disposed above the bottom surface 25 of the tub 24 and a lower portion which is disposed below the bottom surface 25 of the tub 24. The upper portion and the lower portion of the air pulverizing pipe 110 can be classified based on the lower fixing plate 138 of the tub mounting portion. In the lower portion of the air pulverizing pipe 110, the first pipe 120, the air inlet hole 146, and the second pipe 130 are disposed. In the upper portion of the air pulverizing pipe 110, the air tab mounting portion 116 is disposed.

The air pulverizing pipe 110 is fastened to the tub 24 between the second pipe 130 and the air tab mounting portion 116 where the air tab 180 is mounted. In some implementations, a large amount of air is pulverized by the second pipe 130 and the air tab 180, and vibrations and the noise may be generated. However, the air jet generator 100 is fixed to the tub 24 at the second pipe 130 and the portion adjacent to the air tab 180 where the vibrations are generated. Accordingly, the air jet generator 100 may reduce the vibrations generated in the air pulverizing pipe 110.

The bottom surface 25 of the tub 24 is disposed between the lower fixing plate 138 of the air pulverizing pipe 110 and the fixing ring 190. A sealer 196 for preventing the water flowing on the bottom surface 25 of the tub 24 from leaking downward from the bottom surface 25 of the tub 24 is disposed between the lower fixing plate 138 of the air pulverizing pipe 110 and the fixing ring 190. For example, the sealer 196 may be disposed below and/or above the bottom surface 25 of the tub 24.

The air pulverizing pipe 110 includes the reinforcing protrusions 112 which are formed to reinforce rigidities of the air pulverizing pipe 110 on the outer periphery where the first pipe 120 and the second pipe 130 are formed. The reinforcing protrusions 112 may reinforce the first pipe 120 and the second pipe 130 which are formed to be long with a relatively small diameter.

The reinforcing protrusions 112 are formed to protrude from the outer periphery of the air pulverizing pipe 110 in a length direction in which the first pipe 120 and the second pipe 130 form the channel. Four reinforcing protrusions 112 may be formed on the outer peripheral surface of the air pulverizing pipe 110 at an interval of 90°.

The air tab 180 has a disk shape and includes a plurality of holes 182 penetrating the air tab 180. The water passing through the second pipe 130 passes through the air tab. The air in the water is thirdly pulverized while passing the plurality of holes 182 formed in the air tab 180.

The holes 182 formed in the air tab 180 are densely disposed in the air tab 180 having a disk shape at regular intervals. For example, the air tab 180 may include holes or through holes which are formed in one direction. In addition, the holes 182 may be cross long holes in which oval holes formed in upward and downward direction and oval holes formed perpendicular to the upward and downward direction are coupled.

As a contact area between the hole 182 and the air bubbles increases, a shearing force acting on the air bubbles and a generation amount of air bubbles increase, and thus, the long hole may be more preferable than the through hole. However, if a size of the hole like the cross long hole excessively increases, reliability of the air tab may decrease. Accordingly, the long hole may be preferable. If the size of the hole formed in the air tab increases, the size of the pulverized air may increase. Accordingly, in order to generate micro bubbles, it may be preferable that the hole formed in the air tab has a predetermined size or less.

The air tab 180 includes an air tab plate 181 in which the holes 182 are formed and forming a surface perpendicular to the flow direction of the water, an air tab peripheral surface 184 which extends in a direction perpendicular to the peripheral surface of the air tab plate 181, and a fastening protrusion 186 which protrudes radially outward on one side of the air tab peripheral surface 184.

In some implementations, the air tab peripheral surface 184 may extend downward from the air tab plate 181. The air tab plate 181 and the air tab peripheral surface 184 may be formed in one implementation, but may be also be formed in separate implementations.

The air tab peripheral surface 184 may have a cylindrical shape having a hollow inner portion. The air tab plate 181 is disposed above the air tab peripheral surface 184. The inner peripheral surface of the air tab peripheral surface 184 is mounted on the air pulverizing pipe 110, and forms a flow path to which the water inside the air pulverizing pipe 110 flows. The inner peripheral surface of the air tab peripheral surface 184 may have the same diameter as that of the extended pipe portion of the air pulverizing pipe 110.

The fastening protrusion 186 meshes with the fastening groove 117 of the air tab mounting portion 116 to be fastened thereto, and fixes the air tab 180 so that the air tab 180 is disposed inside the air pulverizing pipe 110.

The air tab 180 may be attached to or detached from the air pulverizing pipe 110 upward. Accordingly, when soil is accumulated in the air tab and the air tab is blocked, the air tab 180 may be detached from the air pulverizing pipe 110 to remove the soil.

An upper portion of the air tab 180 is coupled to the nozzle 200. The air tab 180 and the nozzle 200 may be coupled to each other by a fusion method.

The air tab 180 may include a fastening member 188 for fastening the nozzle 200 disposed above the air tab 180. The fastening member 188 is formed to protrude upward on the upper portion of the air tab 180 and may have a groove where a fastening hook 202 formed in the nozzle 200 can be inserted. The fastening member 188 of the air tab 180 is fastened to the fastening hook 202 of the nozzle 200, and thus, the nozzle 200 and the air tab 180 can be fixed to each other.

The nozzle 200 is disposed above the air pulverizing pipe 110. The nozzle 200 is disposed above the air jet generator 100 and discharges the water passing through the air jet generator 100 to the inside of the tub 24. Moreover, the nozzle 200 is disposed above the air tab 180. The nozzle 200 may be coupled to the air tab 180 by a fusion method.

A lower side of the nozzle 200 is formed to be in close contact to an upper side of the air tab 180. The nozzle 200 may include the fastening hook 202 which is fastened to the fastening member 188 of the air tab 180. The nozzle 200 is coupled to the air tab 180. Accordingly, the user may rotate the nozzle protruding upward from the bottom surface 25 of the tub 24 to separate the air tab from the air pulverizing pipe 110.

The nozzle has a cylindrical shape including a hollow inside. An inflow hole 206 which can be opened downward toward a center is formed in a lower end portion of the nozzle 200. The nozzle 200 includes a plurality of discharge holes 204 which are formed downward outside the inflow hole 206 in a radial direction. Moreover, the plurality of discharge holes 204 may be formed above the inflow hole 206. The plurality of discharge holes 204 are open toward the bottom surface 25 of the tub 24. Accordingly, the water discharged through the air jet generator 100 is sprayed to the bottom surface 25 of the tub 24 so as to wash the bottom surface 25 of the tub 24.

The plurality of discharge holes 204 are formed at regular intervals along the peripheral surface of the nozzle 200. The nozzle 200 includes the plurality of discharge holes 204 along the peripheral surface thereof, and thus, the water including the air bubbles can be discharged to the bottoms surface of the tub 24 in various ways.

Four discharge holes 204 may be formed in the nozzle 200. The four discharge holes 204 may be disposed to be separated from each other at regular angles along the peripheral surface of the nozzle 200.

The water including the air bubbles through the air jet generator 100 is discharged to the bottom surface of the tub 24 and flows to the sump. As the water flows to the bottom surface of the tub 24, the bottom surface of the tub 24 can be washed.

In the air jet generator 100, the flow path where the water flows is disposed perpendicular to the ground of the bottom surface of the tub 24. Accordingly, it may be possible to minimize a region where the water flowing through the second pipe 130 cannot flow due to a rapid expansion of the flow path in the second pipe upper portion 134.

FIGS. 8A and 8B and FIGS. 9A and 9B are views illustrating a friction range between the air and the water in the air jet generator and a friction range between the air and the water in the air jet generator in which the extended pipe portion is not provided.

Figure 8A:
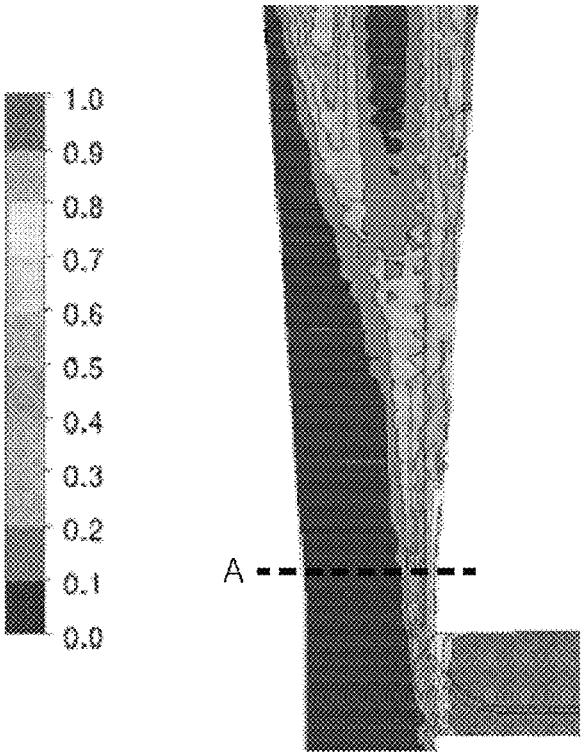
FIG. 8A illustrates an inflow of air and a flow and friction of water along a side cross section of a water flow path in an air jet generator without an extended pipe portion.
Figure 8B:
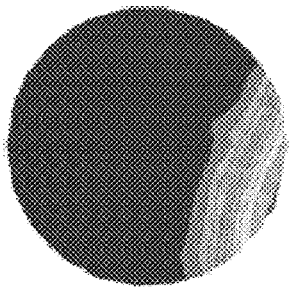
FIG. 8B illustrates ranges of the water and the air of a cross section taken along A of FIG. 8A.

As illustrated in the FIGS. 8A and 8B, when the extended pipe portion is not provided, the air flowing in through the air inlet hole comes into contact with the water discharged through the first pipe on the surface of the air inlet hole. In this case, the friction is generated at a small range, and thus, the noise may be largely generated by the friction.

Figure 9A:
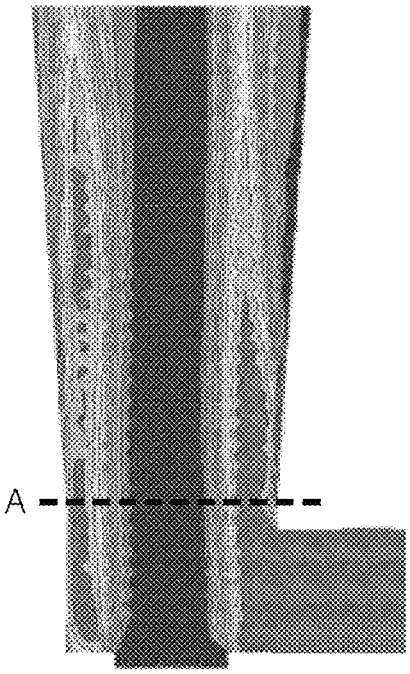
FIG. 9A illustrates an inflow of air and a flow and friction of water along a side cross section of a flow path in an air jet generator implemented with an extended pipe portion.
Figure 9B:
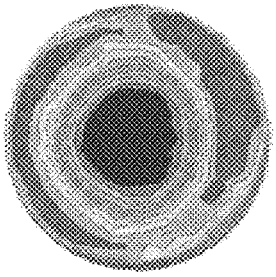
FIG. 9B illustrates ranges of the water and the air of a cross section taken along A of FIG. 9A.

Meanwhile, in the case of the air jet generator of the present disclosure, as illustrated in FIGS. 9A and 9B, there is no direct friction between the air flowing in through the air inlet hole and the water discharged through the first pipe. That is, in a state where an air layer is formed around the water discharged through the first pipe, the air comes into contact with the water via the extended pipe portion.

In this case, a contact area and a friction area between the water and the air increase, and thus, it may be possible to reduce the noise generated by the friction.

The present disclosure, as described above, may be replaced, modified and changed in various different forms without departing from the technical spirit of the disclosure by one having ordinary skill in the art to which the disclosure pertains. Thus, the present disclosure should not be construed as being limited to the embodiments and drawings set forth herein.

According to the dish washer of the present disclosure, the following one or more effects can be obtained.

First, the upper end portion of the first pipe of the air pulverizing pipe and the air inlet hole are disposed within a predetermined gap through the extended surface portion therebetween, and thus, it may be possible to reduce the noise generated by the air flowing into the air pulverizing pipe.

Second, the air chamber is disposed on the path through the noise flowing into the air pulverizing pipe is propagated to the outside, and thus, the noise generated in the air pulverizing pipe can be secondarily reduced.

Third, the air inlet hole communicating with the air pulverizing pipe is formed below the air chamber, and thus, it may possible to prevent the water from remaining in the air chamber.

Effects of the present disclosure are not limited to the above-described effects, and other effects not mentioned are clearly understood by a person skilled in the art from descriptions of claims.

What is claimed is:

1. A dish washer comprising:

a tub defining a washing space;

a spray module disposed inside the tub and configured to spray water to the washing space;

a sump configured to store water;

a washing pump configured to supply the water stored in the sump to the spray module;

an air jet generator disposed below a bottom surface of the tub and configured to (i) receive a portion of the water discharged from the washing pump to generate air bubbles in the water and (ii) discharge the water having air bubbles to the washing space, wherein the air jet generator includes:

an air pulverizing pipe including a first pipe providing (i) an inlet at an upstream side of the air pulverizing pipe, (ii) an opening in a water flowing direction, and (iii) a cross-sectional area reducing in the water flowing direction, and a second pipe disposed above the first pipe, the second pipe providing (i) an opening in the water flowing direction and (ii) a cross-sectional area increasing in the water flowing direction, and an air tab disposed at an upper portion of the second pipe and vertically provided with a plurality of air holes; and an air chamber that defines a space on a peripheral surface of the air pulverizing pipe, wherein an air inlet hole is provided around a peripheral surface of the second pipe to provide fluid communication between an outside of the second pipe and an inside of the second pipe, wherein the air pulverizing pipe includes an extended surface portion which extends in a radial direction at a discharge end portion of the first pipe and extends an area of flow path of an inlet end portion of the second pipe, wherein the air chamber includes an air guide pipe extending along an inner lower surface of the air chamber, adjacent to the air inlet hole, wherein the air inlet hole is provided between the air chamber and the second pipe of the air pulverizing pipe, and wherein the air chamber defines an outside air inflow hole through which external air flows into the space of the air chamber at an upper end portion of the air chamber.

2. The dish washer of claim 1, wherein the air inlet hole is separated by a predetermined interval in a radial direction from an inner circumferential surface of the discharge end portion of the first pipe.

3. The dish washer of claim 1, wherein a diameter of the inlet end portion of the second pipe is larger than a diameter of the air inlet hole.

4. The dish washer of claim 1, wherein the extended surface portion is provided perpendicularly to the water flowing direction.

5. The dish washer of claim 1, wherein the air inlet hole is provided perpendicularly to a direction of a flow path where the water flows into the second pipe.

6. The dish washer of claim 1, wherein the first pipe includes:

a first pipe lower portion having a cross-sectional area reducing in the water flowing direction, the cross-sectional area reducing a pressure of the water flowing in the air pulverizing pipe; and a first pipe upper portion having a corresponding cross-sectional area, wherein a rate of change in the corresponding cross-sectional area of the first pipe upper portion is less than that of the first pipe lower portion to increase or maintain a velocity of the water flowing through the first pipe lower portion.

7. The dish washer of claim 1, wherein the air chamber comprises:

a chamber body defining the space therein and including an opening on a peripheral surface of the air pulverizing pipe; and a chamber housing cover covering the opening of the chamber body.

8. The dish washer of claim 1, further comprising:

an impeller including a vane which provides an inclined surface in the water flowing direction to form a swirl in the water flowing into the air pulverizing pipe.

9. The dish washer of claim 1, further comprising:

a nozzle mounted above the air pulverizing pipe and mounted on an upper side of the bottom surface of the tub, wherein the nozzle is configured to discharge the water flowing through the air pulverizing pipe to the washing space of the tub.

10. The dish washer of claim 9, wherein the nozzle is connected to an upper side of the air tab, and wherein a discharge port discharging the water to the washing space is disposed above the bottom surface of the tub and in the nozzle.

11. The dish washer of claim 10, wherein the discharge port is provided toward the bottom surface of the tub.

12. The dish washer of claim 1, wherein, based on the washing pump being operated, the water flows upwards from the first pipe towards the second pipe.

* * * * *